United States Patent [19]

Barsky

[11] 3,997,165

[45] Dec. 14, 1976

[54] CHECKERS-LIKE GAME

[76] Inventor: William Barsky, 5715 Ave. H, Brooklyn, N.Y. 11234

[22] Filed: Feb. 27, 1975

[21] Appl. No.: 553,525

[52] U.S. Cl. ..... 273/131 AB; 273/131 KC; 273/136 R

[51] Int. Cl.[2] ..... A63F 3/00

[58] Field of Search ..... 273/131, 137

[56] References Cited

UNITED STATES PATENTS

| | | | |
|---|---|---|---|
| 603,539 | 5/1898 | Pycroft | 273/131 BA |
| 3,186,716 | 6/1965 | Shabarick | 273/137 R |
| 3,751,039 | 8/1973 | Dykoski | 273/131 AC |
| 3,834,708 | 9/1974 | Shoptaugh | 273/131 BA X |

FOREIGN PATENTS OR APPLICATIONS

| | | | |
|---|---|---|---|
| 1,000,515 | 10/1951 | France | 273/131 K |
| 163,928 | 11/1933 | Switzerland | 273/131 E |

*Primary Examiner*—Delbert B. Lowe

[57] ABSTRACT

In a preferred embodiment of the invention, there is provided a playing board typically of the shape and general appearance of a Kings checkers board, where there are two opposing groups of playing pieces which are movable forwardly until becoming a king checker, and then can move in any direction and can capture by jumping, the present game having two groups of unlike pieces, one-half of the player's pieces being circular and the other-half of the player's pieces having a square base, one group being of one color scheme for one player and the group being of a different color scheme for the second player, corresponding to shapes of staggered rows of alternately square and circular spaces on the upper surface of the playing board, circular pieces moving and jumping to and fro only on circular spaces, and square-based pieces moving and jumping to and fro only on the square spaces, and pieces being movable only forwardly until reaching the king line and thereafter being movable in any direction on its type space, such being capable of jumping in lateral or forward directions before kinging and also backwardly after kinging.

4 Claims, 6 Drawing Figures

CHECKERS-LIKE GAME

The present invention relates to a game which is a variation on a sectional checkers game.

BACKGROUND OF THE INVENTION

As to the present invention there has existed over the years the sectional checker board and hand checkers, together with numerous varieties of checker games that may be played on the board. There have been alternate games such as chess and variations thereof which normally have resembled chess or checkers, together with the usual complexities and have had difficulty of learning and remembering and playing such games, or being difficult to players seeking light recreation, or ranging in series of ages from childhood to old age.

SUMMARY OF THE INVENTION

Accordingly, the object of the present invention includes the originating and producing of a novel checker game of improved characteristics overcoming the problem difficulty of the past to just about all, together with other novel advances.

More particularly, another object is to obtain a different game of great simplicity of play such that any age or mentality is readily adjustable to enjoyable playing as pastime, while apparently the more experienced and deep thinkers are equally challenged by the unlimited possibilities of play.

Another object is to provide a game basically similar to checkers but affording greater challenge and possibilities of play.

Another object is to obtain a game of which the components are simple and inexpensive, making the game readily available at low cost to the contending public.

Other objects become apparent from the preceding disclosure.

One or more objects of the invention are obtained by the specification described herein.

Probably the invention may be defined as a checkers-like-board of miniature shape size but preferably characterized by a square shape of the type of conventional checkers boards, in which instead of holes of division squares or blank spaces being entirely square, alternate spaces are different and there is made from outer spaces such as one group of spaces of each negative row being intermediate and square for every other space and the intermediate space therebetween being round, such that the apparatus includes two sets of playing spaces of the playing board, one being for square playing pieces and the other being for round playing pieces. Each player has half of the spaces, for example, of a square shape and the remainder of a round shape of all the same color preferably, while the opposing player has another different color a corresponding number of each of square and round (circular) playing pieces. The potential moves for each of these playing pieces may be varied within the spirit of the invention, but all pieces as in conventional checkers must move diagonally forwardly one space at a time but may jump a space to thereby move forwardly two rows at a time, and as in conventional checkers a series of consecutive jumps may be linked in a single move of the person's or player's turn of move. However, in a preferred embodiment of the invention, the playing pieces may jump either forwardly, diagonally forwardly, or laterally with the piece of an opponent to thereby capture the piece as in conventional checkers. Whenever a playing checker or piece is used in the king line of his opponent, then that playing piece may move or jump in any direction forwardly, laterally, backwardly, diagonally in a forward direction, or diagonally in a rearward direction, as it may be desired. It is redundant to state that a checker or playing piece can jump his own man or other checkers of a different shape, namely a square checker may not jump on another square space of the same color or may it jump a circular checker of the same color.

The invention may be better understood by making reference to the figures as follow.

THE FIGURES

Figures 3A, 3B:
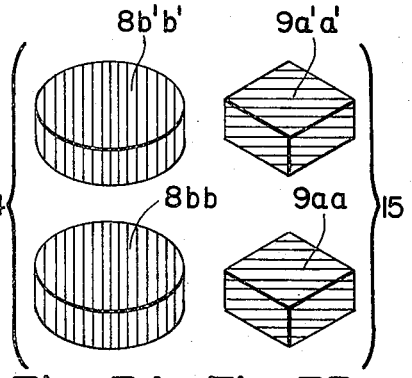

FIGS. 3A and 3B respectively represent exploded views of double decker playing pieces after they respectively have reached the king line and become kings.

Figures 4A, 4B:
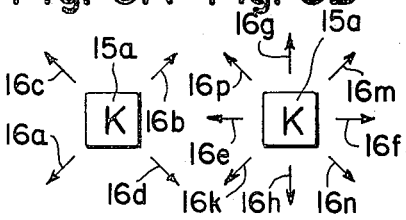

FIGS. 4A and 4B respectively illustrate move capabilities and jump capabilities of a king playing piece of the type illustrated by the king of FIG. 3B, for example, in elevation plan view.

DESCRIPTION OF THE INVENTION

Figure 1:
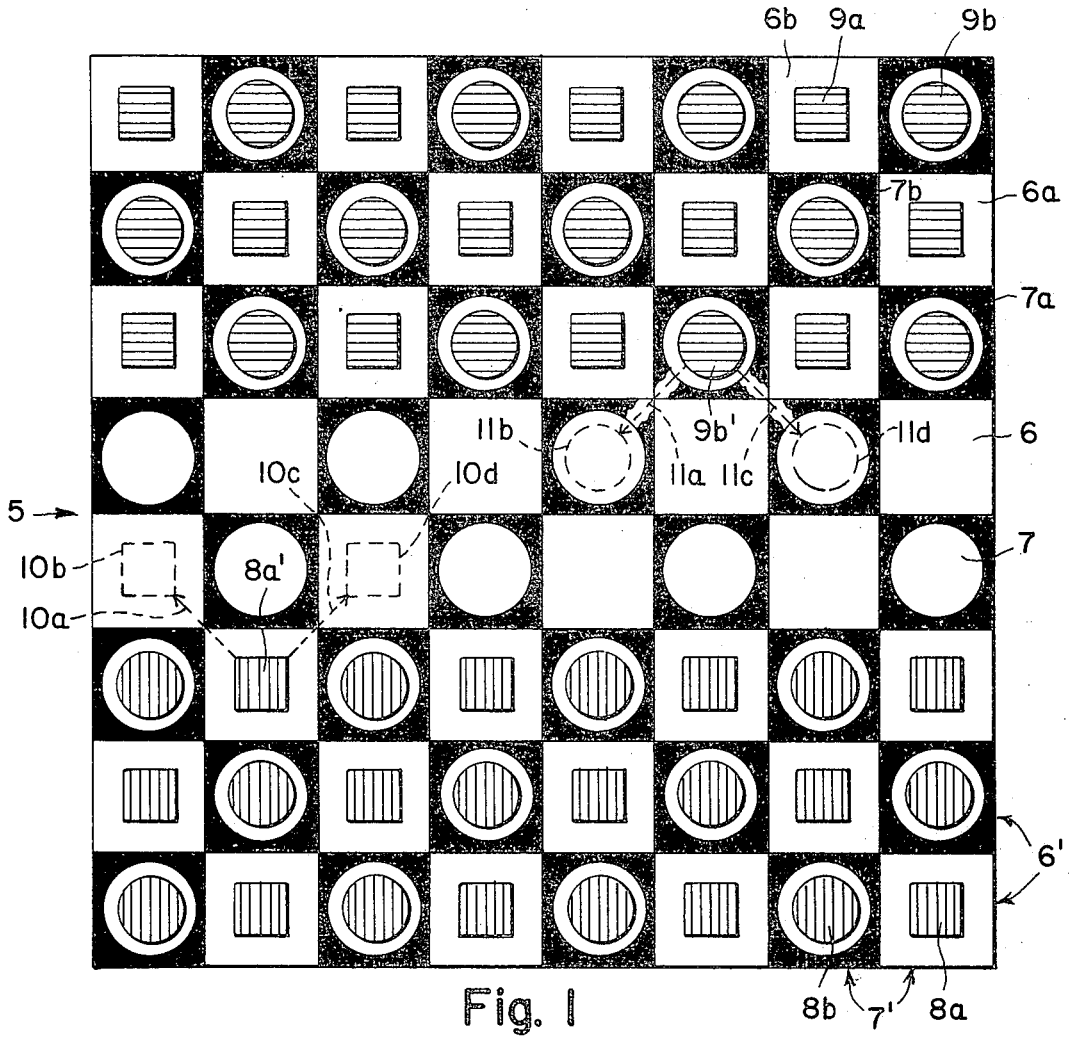
FIG. 1 is an elevation plan view of a preferred embodiment of the inventive playing board and playing pieces of the present invention.
Figure 2:
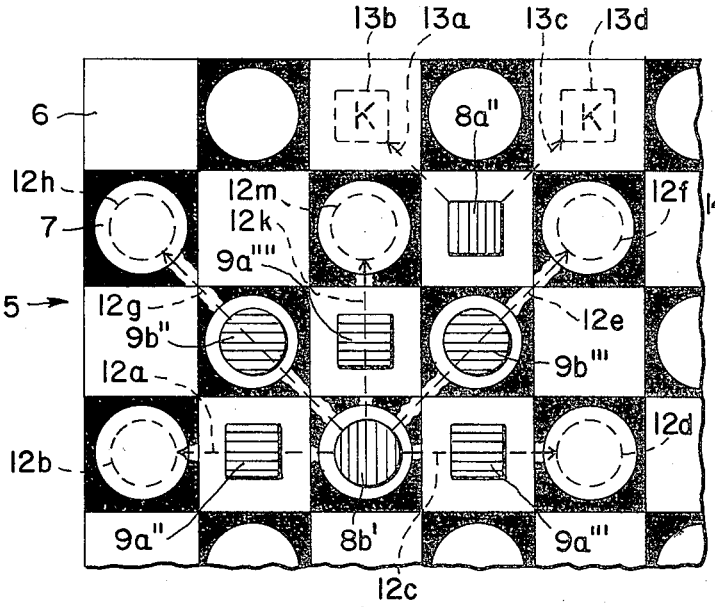
FIG. 2 illustrates an end-part view of the same playing board as that of FIG. 1, except illustrating those capabilities of various playing pieces relative to various spaces of the playing board.

In greater detail, FIGS. 1 and 2 represent elevation plan views of the same preferred embodiment of the present invention, and in like manner FIGS. 3A and 3B and FIGS. 4A and 4B represent also a preferred embodiment for the present invention for the king-state of the playing pieces.

FIGS. 1 and 2 each illustrate the playing board 5 having alternate and staggered square playing spaces 6 such as the diagonally aligned spaces 6*a* and 6*b*, and having alternating and staggered circular spaces 7 such as diagonally aligned spaces 7*a* and 7*b*. Particularly the playing pieces of one opponent player are represented by square playing pieces 8*a* and circular playing pieces 8*b* of one particular predetermined color, while the remaining playing pieces for the other opponent player are represented as square playing pieces 9*a* and circular playing pieces 9*b*.

In FIG. 1, for a particular square playing piece 8*a*′, it is illustrated that this playing piece 8*a*′ may move in either diagonal direction 10*a* to position 10*b* or direction 10*c* to position 10*d*. Accordingly this particular piece 82′ is representative of any square playing piece and that for forward moves it may move only diagonally in one or the other of diagonally forward directions. In like manner, for the opponent playing pieces it is illustrated that particularly the circular playing pieces such as for example the specific particular round playing piece 9*b*′ may move in forward directions in either of diagonal directions such as 11*a* to positions 11*b* or 11*c* to position 11*d* illustrated for piece 9*b*′.

FIG. 2 illustrates jump capabilities for a particular playing piece, it being noted also that the same would be true for a square playing piece with regard to its playing spaces, the circular playing pieces being played always to play for landing on circular playing spaces, and substantially square playing pieces play for and must always land on square playing spaces. With regard to FIG. 2, it is observed that particular circular playing piece 8*b'* may jump an opposing different colored square playing piece, or circular playing piece, in any lateral direction or directly forward direction for the square playing pieces and diagonally forward for the circular playing pieces, as for example the circular playing piece 8*b'* may jump the square playing piece 9*a''* to free space position 12*b* in direction 12*a*. Similarly the circular playing piece 8*b'* may jump circular playing piece 9*b''* in direction 12*g* to land on open space 12*h*. Substantially round playing piece 8*b'* may jump square playing piece 9*a''''* in direction 12*k* to land on free space 12*m*. Similarly the round playing piece 8*b'* may jump the circular playing piece 9*b'''* in direction 12*e* to land in free circular space 12*f*. In like manner the round playing piece 8*b'* may jump square playing piece 9*a'''* in direction 12*c* to land on the circular space 12*d*.

In FIG. 3A there is illustrated an exploded perspective view of a playing piece that has previously been kinged in a conventional manner by having one circular playing piece on top of the other circular playing piece. In like manner, in FIG. 3B there is illustrated a king-state exploded perspective view of a square playing piece. Accordingly, FIG. 3A illustrates a circular king-state made up of circular piece 8*bb* kinged by circular playing piece 8*b'b'* while FIG. 3B illustrates a square playing piece 9*aa* kinged by square playing piece 9*a'a'* to result in king playing piece 14 and king playing piece 15.

FIG. 4A illustrates typical move capabilities of a king, such as the illustrated particular king square piece 15*a* which may move preferably only one space in any direction, as alternate diagonal directions 16*a*, 16*b*, 16*c* and 16*d*, provided the space is not occupied already.

FIG. 4B illustrates typical jump capabilities over preferably a maximum of one playing space occupied by an opponent playing piece, provided the space to which it is jumping is free of any other playing piece. It is to be understood, however, that preferably the king may jump serially a series of alternate opponent playing pieces in a single turn of play, as in conventional checker games.

Preferably there are 48 pieces, 24 pieces of one color such as black and 24 of another color, such as white, and each 24 of each color include 12 square playing pieces and 12 round playing pieces. However, playing spacing may be more or less than illustrated, and in either more or fewer rows and similarly the number of playing pieces may be varied.

The composition of the board and/or playing pieces is immaterial, typically being a paper-mat board and wood or plastic playing pieces.

I claim:

1. A game device comprising in combination: a playing board means for providing an upper surface adapted for the moving of playing pieces therealong and for providing a plurality of rows of playing spaces, substantially as shown in FIG. 1, the playing spaces being of two different shape-varieties with consecutive rows off-set in juxtaposition throughout the playing board surface, said two different shape-varieties of playing spaces including a first variety of playing spaces each being of a first predetermined shape and a different second variety of playing spaces each being of a different second predetermined shape as compared to the first predetermined shape; a plurality of playing piece means for providing first and second different-shape types of playing pieces substantially as shown in FIGS. 1, 3A and 3B, the first and second different-shape types of playing pieces being each adapted for being moved along said upper surface and the first and second different-shape types respectively of playing pieces being characterized by different physical properties of appearance the first different-shape type being of a base circumscribing peripheral shape corresponding to and adapted for playing to and from and for resting on solely the first variety of playing spaces and the second different-shape type being of a base circumscribing peripheral shape corresponding to and adapted for playing to and from and resting on solely the second variety of playing spaces, jointly (a) the playing piece means in differing shapes of said first different-shape type and said second different-shape type of playing pieces and (b) the playing board means in respective corresponding differing shapes of said first predetermined shape and the different second predetermined shape, characterizing a first half of each of the first and second different-shape types of playing pieces to be movable in first directions toward a first opposing edge of the playing board means, and further characterizing a second half of each of the first and second playing pieces to be movable to reach a playing space adjacent one of the opposing edges to thereafter be movable in both said first and second directions, and further characterizing each of the first half of playing pieces to be movable in the first direction to an adjacent unoccupied playing space of said first variety and jumpable over any adjacent space of said first variety or said second variety occupied by a playing piece of said first different-shape type or said second different-shape type to an unoccupied playing space of said first variety in any direction other than said second direction, and further characterizing each of the second half of playing pieces to be movable in the second direction to an adjacent unoccupied playing space of said second variety and jumpable over any adjacent space of said second variety or said first variety occupied by a playing piece of said second different-shape type or said first different-shape type to an unoccupied playing space of said second variety in any direction other than said first direction; and said playing spaces of said first variety being substantially square and said playing spaces of said second variety being substantially circular.

2. A game device of claim 1, in which playing spaces of said first variety are of a different color scheme as compared to the color scheme of playing spaces of said second variety.

3. A game device of claim 2, in which playing pieces of said first half are of a color scheme different from color scheme of playing pieces of said second half.

4. A game device of claim 1, in which playing pieces of said first type each have a substantially square base, and in which playing pieces of said second type each have a substantially circular base.

* * * * *